US009099035B2

(12) United States Patent
Shin et al.

(10) Patent No.: US 9,099,035 B2
(45) Date of Patent: Aug. 4, 2015

(54) ORGANIC LIGHT EMITTING DISPLAY AND METHOD OF DRIVING THE SAME

(75) Inventors: Kwang-Suk Shin, Yongin (KR); Won-Jun Choe, Yongin (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 978 days.

(21) Appl. No.: 13/250,306

(22) Filed: Sep. 30, 2011

(65) Prior Publication Data

US 2012/0306936 A1 Dec. 6, 2012

(30) Foreign Application Priority Data

May 31, 2011 (KR) ..... 10-2011-0052058

(51) Int. Cl.
*G09G 3/32* (2006.01)

(52) U.S. Cl.
CPC ..... *G09G 3/3225* (2013.01); *G09G 3/3233* (2013.01); *G09G 3/3208* (2013.01); *G09G 3/3291* (2013.01); *G09G 2300/0819* (2013.01); *G09G 2300/0861* (2013.01); *G09G 2320/064* (2013.01); *G09G 2320/0606* (2013.01); *G09G 2320/0626* (2013.01); *G09G 2320/0633* (2013.01); *G09G 2320/0646* (2013.01); *G09G 2320/0653* (2013.01)

(58) Field of Classification Search
CPC ..... G09G 3/3225; G09G 2300/0861; G09G 2320/0606; G09G 2320/0626–2320/0653; G09G 3/3233; G09G 3/3208; G09G 2300/0819; G09G 3/3291; G09G 2300/0852; G09G 2320/0276; G09G 2360/16; G09G 3/3648; G09G 3/3611; H05B 33/0896
USPC ..... 345/76–83, 204–214, 690–699; 315/169.3
See application file for complete search history.

(56) References Cited

U.S. PATENT DOCUMENTS

| | | | | |
|---|---|---|---|---|
| 8,565,556 | B2 * | 10/2013 | Toda | 382/300 |
| 2004/0036704 | A1 * | 2/2004 | Han et al. | 345/690 |
| 2004/0223007 | A1 * | 11/2004 | Mamata | 345/690 |
| 2005/0225518 | A1 * | 10/2005 | Yamada et al. | 345/77 |
| 2006/0033445 | A1 * | 2/2006 | Kim et al. | 315/169.3 |
| 2007/0139406 | A1 * | 6/2007 | Ozawa et al. | 345/211 |
| 2009/0109208 | A1 * | 4/2009 | Yamashita et al. | 345/214 |
| 2010/0309174 | A1 * | 12/2010 | Tomida et al. | 345/204 |
| 2011/0187754 | A1 * | 8/2011 | Yoo | 345/690 |
| 2011/0205442 | A1 * | 8/2011 | Mori et al. | 348/673 |
| 2011/0285759 | A1 * | 11/2011 | Sakai | 345/690 |

FOREIGN PATENT DOCUMENTS

| | | | |
|---|---|---|---|
| KR | 10-2005-0074363 | A | 7/2005 |
| KR | 10-2007-0051518 | A | 5/2007 |
| KR | 10-2009-0016951 | A | 2/2009 |

* cited by examiner

*Primary Examiner* — Dmitriy Bolotin
(74) *Attorney, Agent, or Firm* — Knobbe, Martens, Olson & Bear LLP

(57) ABSTRACT

An organic light emitting display and a method of driving the display are disclosed. The organic light emitting display limits the rate of brightness change so as to reduce undesired visual artifacts.

20 Claims, 4 Drawing Sheets

ORGANIC LIGHT EMITTING DISPLAY AND METHOD OF DRIVING THE SAME

CROSS-REFERENCE TO RELATED APPLICATIONS

This application claims priority to and the benefit of Korean Patent Application No. 10-2011-0052058, filed on May 31, 2011, in the Korean Intellectual Property Office, the entire content of which is incorporated herein by reference.

BACKGROUND

1. Field

The disclosed technology relates to an organic light emitting display and a method of driving the same, and more particularly, to an organic light emitting display having improved display quality and a method of driving the same.

2. Description of the Related Technology

Recently, various flat panel displays (FPDs) having reduced weight and volume as compared to cathode ray tubes (CRTs) have been developed. The FPDs include liquid crystal displays (LCDs), field emission displays (FEDs), plasma display panels (PDPs), and organic light emitting diode (OLED) displays.

Among the FPDs, the organic light emitting diode displays display images using OLEDs that generate light through the re-combination of electrons and holes. Organic light emitting diode displays have high response speed and are driven with low power consumption.

An organic light emitting diode display includes a plurality of data lines, scan lines, and pixels arranged at intersections of the scan and data lines. in most embodiments, each pixel includes an organic light emitting diode (OLED) and a pixel circuit for controlling the amount of current that flows to the OLED. The pixels charge the voltages corresponding to data signals and generate light with predetermined brightness by supplying the currents corresponding to the charged voltages to the OLEDs.

The brightness of the organic light emitting diode display is based on a signal input from the outside (for example, a user). For example, the user selects specific brightness among brightness components of 0 to 100% and the organic light emitting display displays an image with the brightness selected by the user.

Here, when the brightness of a panel rapidly changes according to the brightness signal, a change in brightness is observed by the user so that display quality deteriorates. In addition, when noise is included in the brightness signal, an undesired change in brightness is generated in the panel.

SUMMARY OF CERTAIN INVENTIVE ASPECTS

One inventive aspect is an organic light emitting display, which includes a pixel unit with pixels positioned at intersections of scan lines and data lines. The display also has a brightness controller for generating second brightness signals using first brightness signals, and an emission control unit for controlling brightness components of the pixels to correspond to the second brightness signals, where the brightness controller generates the second brightness signals so that brightness of the pixel unit changes by no more than a threshold value.

Another inventive aspect is a method of driving an organic light emitting display. The method includes inputting a first brightness signal of an ith frame, outputting the first brightness signal of the ith frame if the first brightness signal of the ith frame is a normal signal, and averaging brightness values of first brightness signals of at least two frames adjacent to the ith frame if the first brightness signal of the ith frame is an abnormal signal. The method also includes determining whether the difference between brightness values of the ith frame and the (i−1)th frame is less than a threshold value, and increasing or reducing the brightness value of the first brightness signal of the (i−1)th frame by the threshold value during each frame if the difference is not less than the threshold.

BRIEF DESCRIPTION OF THE DRAWINGS

The accompanying drawings, together with the specification, illustrate exemplary embodiments, and, together with the description, serve to explain various aspects and principles.

DETAILED DESCRIPTION OF CERTAIN INVENTIVE EMBODIMENTS

Figure 1:
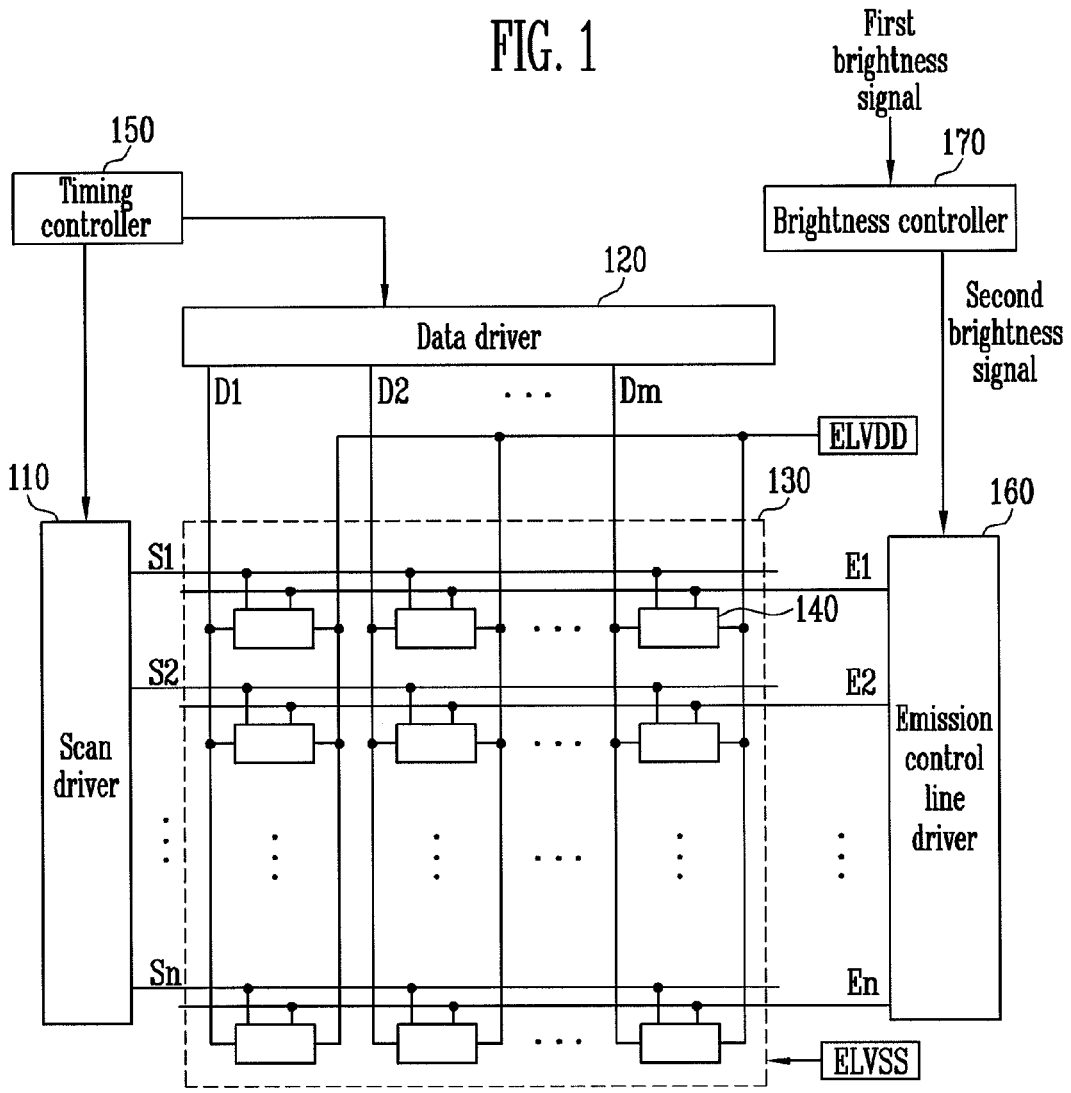
FIG. 1 is a block diagram illustrating an organic light emitting display according to an embodiment.

Hereinafter, certain exemplary embodiments are described with reference to the accompanying drawings. Here, when a first element is described as being coupled to a second element, the first element may be either directly coupled to the second embodiment or may be indirectly coupled to the second element via a third embodiment. Further, some of the elements that are not essential to the complete understanding of the invention are omitted for clarity. Also, like reference numerals generally refer to like elements throughout.

FIG. 1 is a block diagram illustrating an organic light emitting display according to an embodiment. Referring to FIG. 1, the organic light emitting display according to the shown embodiment includes a pixel unit 130 including pixels 140 positioned at the intersections of scan lines S1 to Sn, emission control lines E1 to En, and data lines D1 to Dm, a scan driver 110 for driving the scan lines S1 to Sn, an emission control line driver 160 for driving the emission control lines E1 to En, a data driver 120 for driving the data lines D1 to Dm, a brightness controller 170 for supplying a second brightness signal to the emission control line driver 160, and a timing controller 150 for controlling the scan driver 110, the data driver 120, the emission control line driver 160, and the brightness controller 170.

The scan driver 110 sequentially supplies scan signals to the scan lines S1 to Sn. When the scan signals are sequentially supplied to the scan lines S1 to Sn, the pixels 140 are selected in units of lines. The data driver 120 supplies data signals to the data lines D1 to Dm in synchronization with the scan signals. The data signals supplied to the data lines D1 to Dm are supplied to the pixels 140 selected by the scan signals.

The emission control line driver 160 receives the second brightness signal from the brightness controller 170. In response, the emission control line driver 160 generates emission control signals having a duration corresponding to the brightness value of the second brightness signal and sequentially supplies the generated emission control signals to the emission control lines E1 to En. The pixels 140 that receive the emission control signals are set to be in a non-emission state. The pixels 140 that do not receive the emission control signals emit light corresponding to the data signals.

The brightness controller 170 generates the second brightness signal using a first brightness signal supplied from the outside and supplies the generated second brightness signal to the emission control line driver 160. In some embodiments, the brightness controller 170 removes the noise included in the first brightness signal and generates the second brightness signal so that a change in the brightness of the pixel unit 130 is not recognized by an observer. The first brightness signal input from the outside (for example, from a user) has a specific brightness value between 0% to 100%. For example, the user may supply the first brightness signal having the brightness value of 80% according to the light of the external environment.

The timing controller 150 controls the scan driver 110, the data driver 120, the brightness controller 170, and the emission control line driver 160.

The pixel unit 130 includes the pixels 140 positioned at the intersections of the scan lines S1 to Sn and the data lines D1 to Dm. The pixels 140 receive a first power ELVDD and a second power ELVSS. The pixels 140 control the amount of current supplied from the first power ELVDD to the second power ELVSS via organic light emitting diodes (OLED) according to the data signals in a time where the emission control signals are not supplied.

Figure 2:
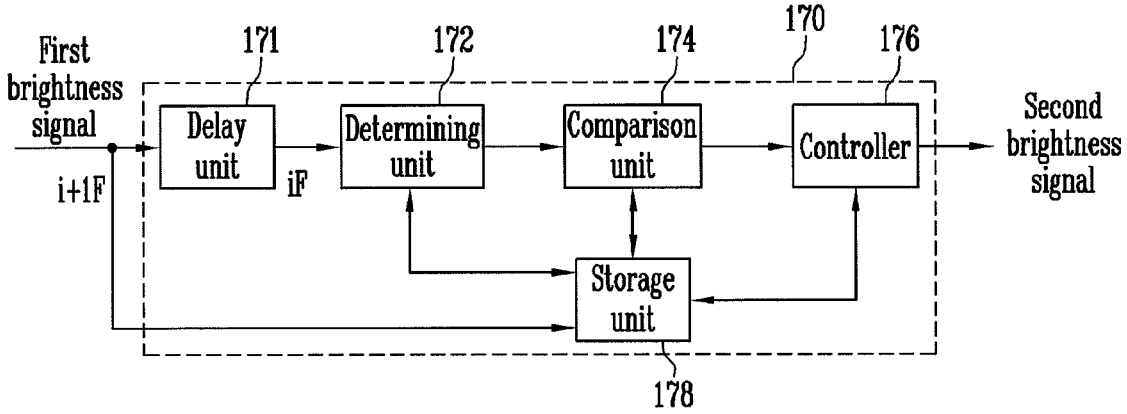
FIG. 2 is a block diagram illustrating an embodiment of the brightness controller of FIG. 1.

FIG. 2 is a block diagram illustrating the brightness controller of FIG. 1. Referring to FIG. 2, the brightness controller 170 includes a delay unit 171, a determining unit 172, a comparison unit 174, a controller 176, and a storage unit 178.

Figure 3:
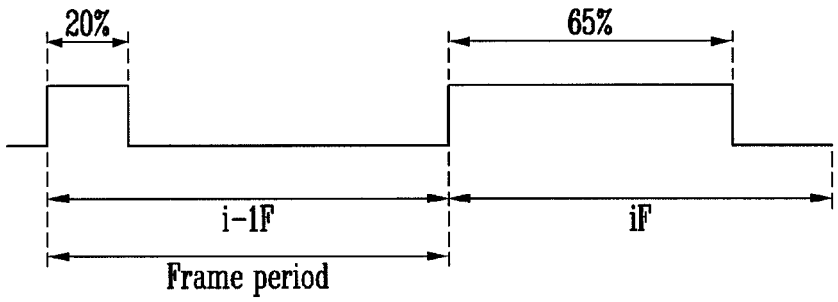
FIGS. 3 and 4 are timing waveform charts illustrating a first brightness signal.

The first brightness signal may be input for each frame as illustrated in FIG. 3. In this embodiment, the first brightness signal has a duration and the brightness value corresponds to the width of a high signal (or a low signal). For example, the first brightness signals having the brightness values of 20% and 65% may be sequentially input in an (i−1)th frame i−1F and an ith frame iF.

The delay unit 171 delays the first brightness signal input by at least one frame to output the delayed first brightness signal. For example, when the first brightness signal corresponding to an (i+1)th frame i+1F is input, the delay unit 171 outputs the first brightness signal corresponding to the ith frame iF.

The determining unit 172 receives the first brightness signal from the delay unit 171. The determining unit 172 stores frame period information in the storage unit 178 to correspond to the periods of a plurality of first brightness signals during initial driving (for example, in a period where a power source is first input or during being forwarded from a factory).

A frame duration is determined by a driving frequency by which the organic light emitting display is driven. That is, the frame duration is determined to correspond to the driving frequency such as 60 Hz, 120 Hz, and 240 Hz. The determining unit 172 receives the plurality of first brightness signals and extracts the frame period information using the durations of the received first brightness signals. The determining unit 172 stores the extracted frame period information in the storage unit 178.

Figure 4:
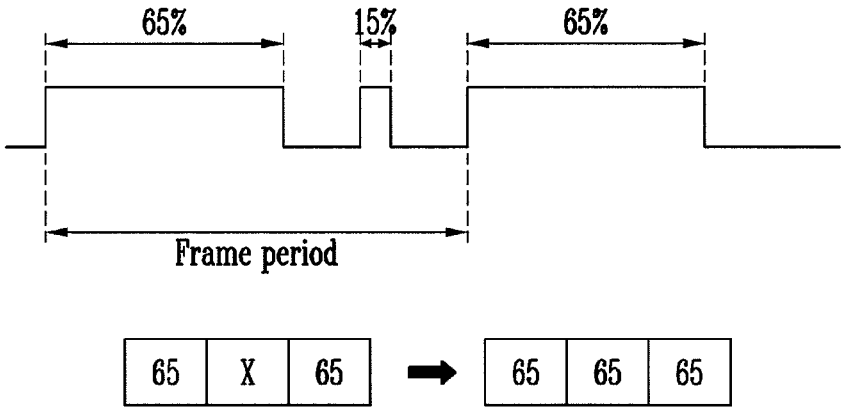

Then, the determining unit 172 determines whether noise is included in the first brightness signals using the durations of the first brightness signals input from the delay unit 171 and the frame duration information stored in the storage unit 178 during normal driving. For example, the determining unit 172 determines that the first brightness signal is a normal signal when one frame duration is substantially equal to the duration of the first brightness signal and determines that the first brightness signal is an abnormal signal when one frame duration does not equal the period of the first brightness signal as illustrated in FIG. 4.

When it is determined that the first brightness signal is a normal signal, the determining unit 172 transmits the input first brightness signal to the comparison unit 174. When it is determined that the first brightness signal is an abnormal signal, the determining unit 172 averages the brightness values of the at least two first brightness signals stored in the storage unit 178 to generate a new first brightness signal and transmits the generated first brightness signal to the comparison unit 174. For example, when it is determined that the first brightness signal of an ith frame iF is abnormal, the determining unit 172 averages the brightness values of the frames adjacent to the ith frame iF, that is, the (i−1)th frame i−1F and the (i+1)th frame i+1F to generate the first brightness signal. Therefore, the brightness values of the at least two first brightness signals are stored in the storage unit 178.

The comparison unit 174 receives the first brightness signal from the determining unit 172. The determining unit 172 that received the first brightness signal determines whether the brightness values of the current frame iF and the previous frame i−1F are within a threshold value. When it is determined that a difference in the brightness values of the current frame iF and the previous frame i−F is no more than the threshold value, the comparison unit 174 generates a first control signal. When it is determined than the difference in the brightness values of the current frame iF and the previous frame i−1F is larger than the threshold value, the comparison unit 174 generates a second control signal.

The threshold value is stored in the storage unit 178 and may be experimentally determined as a value by which a difference in brightness among frames is not recognized. For example, the threshold value may be set as a brightness value between 1% and 20%, preferably, a brightness value between 5% and 10%. The difference threshold value may be generated in accordance with the size and resolution of a panel. However, in some embodiments, when a brightness difference between frames is less than 20%, a brightness difference may not be recognized.

The controller 176 outputs the first brightness signal of the current frame iF as a second brightness signal when the first control signal is input from the comparison unit 174. When the second control signal is input from the comparison unit 174, the controller 176 generates the second brightness signal increased or reduced from the brightness value of the first brightness signal by the threshold value to supply the generated second brightness signal to the emission control line driver 160.

Figure 5:
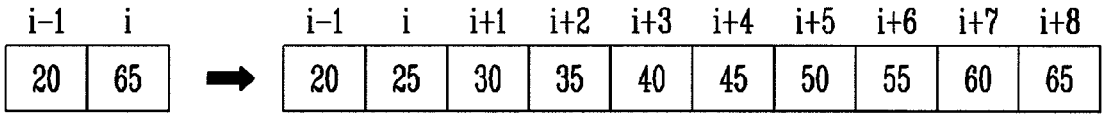
FIG. 5 is a timing view illustrating the brightness value of a second brightness signal generated by the controller of FIG. 2.

If the brightness value of the current frame iF is set as 65%, and the brightness value of the previous frame i−1F is set as 20%, and if the threshold value is set as 5%, the controller 176 generates second brightness signals to increase from the brightness value of the previous frame i−1F by the threshold value in steps as illustrated in FIG. 5. In some embodiments, the controller 176 increases the brightness value of the second brightness signal by the threshold value every frame period so that the brightness value of the second brightness signal is set as the brightness value of the current frame iF to generate the second brightness signal.

On the other hand, the first brightness signals input to the brightness controller 170 in the periods ((i+1)th to (i+7)th frames) where the second brightness signals are increased or reduced in steps are not used as brightness determining signals but are ignored. In detail, the first brightness signals are input from the outside and commonly do not change within, for example, two seconds. Therefore, the first brightness signals input in the periods where the second brightness signals are increased or reduced in stages are determined to have the same brightness value as the current target brightness value (that is, 65%) so that the first brightness signals are not used as the brightness determining signals.

The storage unit 178 stores the above-described frame periods, the threshold value, and the brightness values of the first brightness signals corresponding to the at least two frames (for example, i−1F and i+1F) adjacent to the current frame iF.

Figure 6:
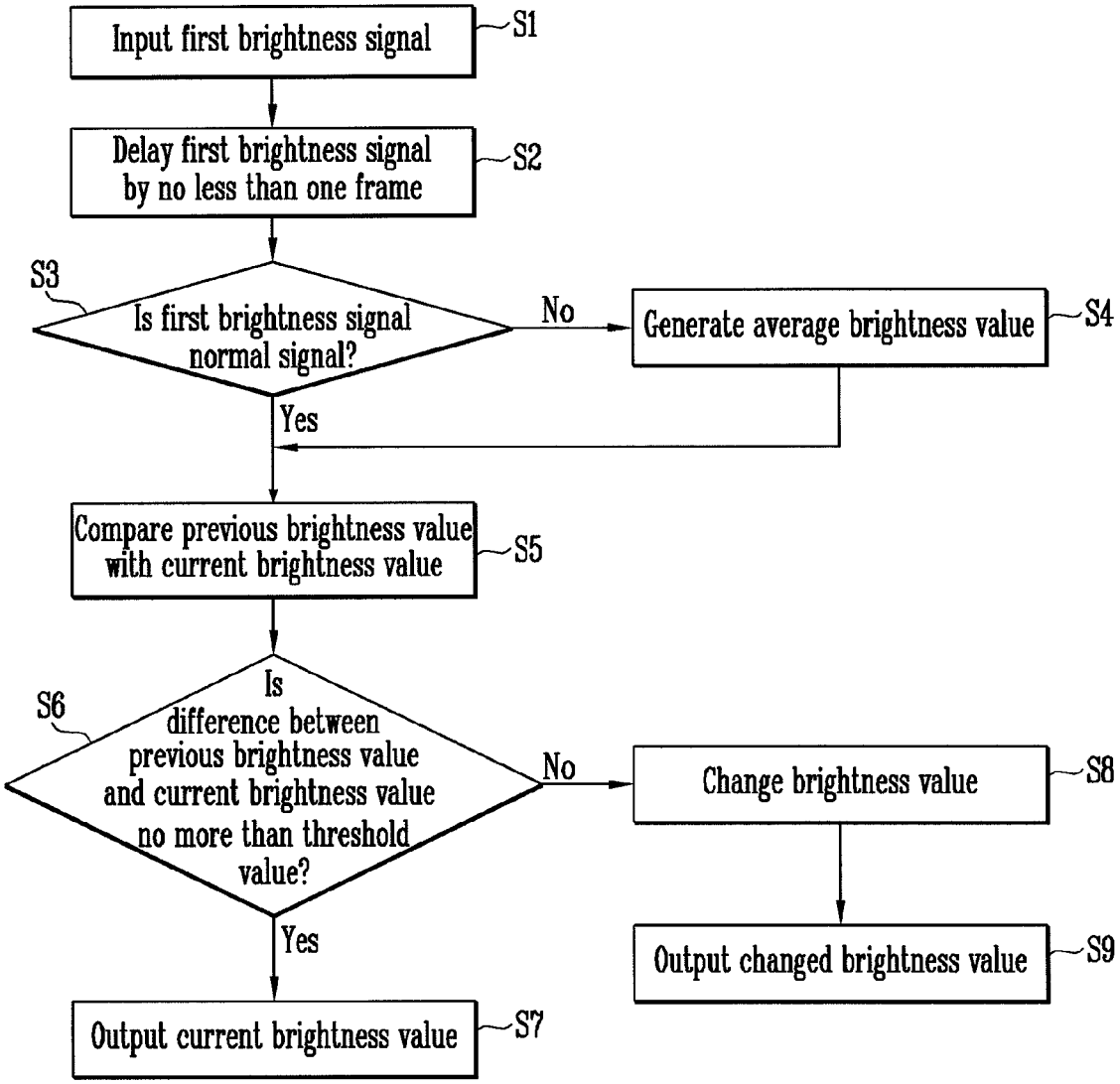
FIG. 6 is a flowchart illustrating a method of driving the organic light emitting display according to the embodiment.

FIG. 6 is a flowchart illustrating a method of driving the organic light emitting display according to the embodiment of the present invention. Referring to FIG. 6, first, a first brightness signal having a brightness value is input from the outside to the delay unit 171 (S1). The delay unit 171 delays the first brightness signal by no less than one frame to supply the delayed first brightness signal to the determining unit 172 (S2).

The determining unit 172 that received the first brightness signal from the delay unit 171 determines whether the first brightness signal is a normal signal by comparing the frame durations stored in the storage unit 178 and the duration of the first brightness signal (S3). When it is determined that the first brightness signal is not a normal signal in S3, the at least two brightness values stored in the storage unit 178 are averaged to generate a new first brightness signal and the generated first brightness signal is transmitted to the comparison unit 174 (S4). When it is determined that the first brightness signal is a normal signal in S3, the currently input first brightness signal is transmitted to the comparison unit 174.

The comparison unit 174 determines whether a difference between the brightness value of the previous frame and the brightness value of the current frame is no more than the threshold value (S5 and S6). If it is determined that the difference between the brightness value of the previous frame and the brightness value of the current frame is no more than the threshold value in S6, the comparison unit 174 supplies the first control signal to the controller 176. If it is determined that the difference between the brightness value of the previous frame and the brightness value of the current frame is greater than the threshold value in S6, the comparison unit 174 supplies the second control signal to the controller 176.

If the controller 176 receives the first control signal in S6, it supplies the current first brightness signal to the emission control line driver 160 as the second brightness signal (S7). If the controller 176 receives the second control signal in S6, it increases or reduces the brightness value of the previous frame by the threshold value (S9) and provides the increased or reduced brightness value to the emission control line driver 160 as the second brightness signal. S9 is repeated for each frame so that the brightness value of the second brightness signal is the same as the brightness value of the first brightness signal of the current frame.

Figure 7:
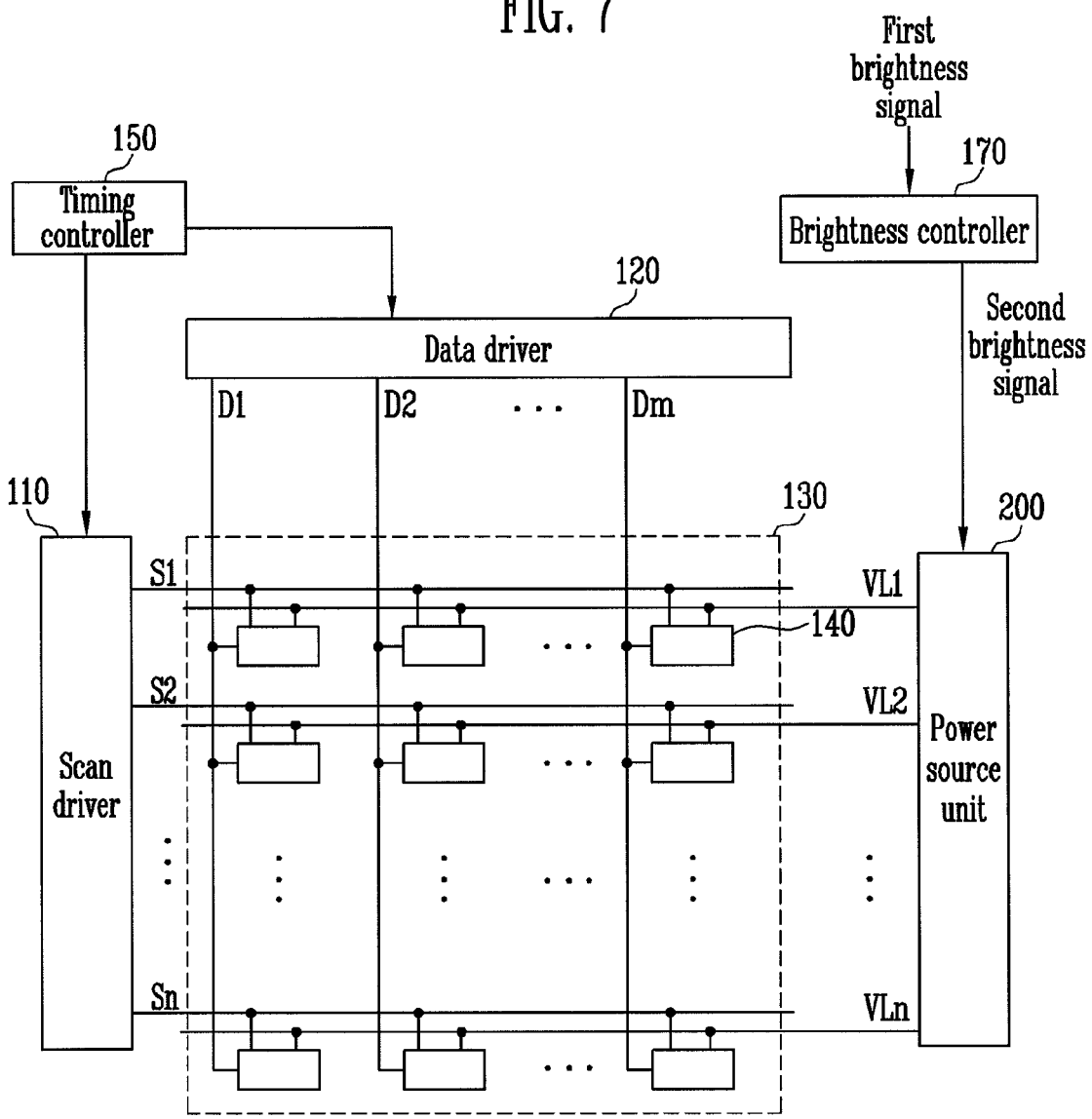
FIG. 7 is a block diagram illustrating an organic light emitting display according to another embodiment.

FIG. 7 is a block diagram illustrating an organic light emitting diode display according to another embodiment. As FIG. 7 is described, elements similar to those of FIG. 1 are generally denoted by the same reference numerals and some description thereof is omitted.

Referring to FIG. 7, the organic light emitting display includes a power source unit 200 for supplying a first power source ELVDD or a second power source ELVSS to power source lines VL1 formed in horizontal lines.

The power source unit 200 controls the emission time of the pixels 140 to correspond to the second brightness signals supplied from the brightness controller 170. That is, the power source unit 200 controls the emission and non-emission times of the pixels 140 by controlling the voltage of the first power ELVDD or the second power ELVSS supplied to the power source lines VL1 to VLn.

In detail, in the embodiment of FIG. 1, the emission of the pixels 140 is controlled using the width of the emission control signals. If the emission control signals are used, a transistor coupled to an emission control line (one of E1 to En) is to be included in each of the pixels 140.

However, some pixels 140 may not have a circuit structure in which the pixels 140 are coupled to the emission control lines E1 to En.

In this case, as illustrated in FIG. 7, the emission of the pixels 140 may be controlled by controlling the voltage of the first power ELVDD or the second power ELVSS.

While the present invention has been described in connection with certain exemplary embodiments, it is to be understood that the invention is not limited to the disclosed embodiments, but, on the contrary, is intended to cover various modifications and equivalent arrangements.

What is claimed is:

1. An organic light emitting display, comprising:

a pixel unit including pixels positioned at intersections of scan lines and data lines;

a brightness controller for generating second brightness signals using first brightness signals; and an emission control unit for controlling brightness components of the pixels to correspond to the second brightness signals, wherein the brightness controller generates the second brightness signals so that brightness of the pixel unit changes by no more than a threshold value, and wherein the emission control unit receives the second brightness signals from the brightness controller.

2. The organic light emitting display as claimed in claim 1, wherein the brightness controller comprises:

a storage unit for storing frame duration information, a threshold value, a brightness value of a first brightness signal of an ith frame, and brightness values of at least two first brightness signals each corresponding to a frame adjacent to the ith frame;

a determining unit for determining whether the first brightness signal of the ith frame is normal using the duration of the first brightness signal of the ith frame and the frame duration information;

a comparison unit for determining whether the brightness value of the first brightness signal of the ith frame supplied from the determining unit and a brightness value of a first brightness signal of an (i−1)th frame stored in the storage unit are included in the threshold value; and a controller for outputting a first brightness signal changed from the ith first brightness signal or the (i−1)th first brightness signal by the threshold value to correspond to the comparison result of the comparison unit as the second brightness signal.

3. The organic light emitting display as claimed in claim 2, wherein the determining unit supplies the first brightness signal of the ith frame to the comparison unit if the duration of the first brightness signal of the ith frame is substantially equal to the frame duration.

4. The organic light emitting display as claimed in claim 2, wherein the determining unit supplies a first brightness signal generated by averaging brightness values of at least two first brightness signals if the duration of the first brightness signal of the ith frame is different from the frame duration.

5. The organic light emitting display as claimed in claim 4, wherein the determining unit averages brightness information of an (i−1)th frame and brightness information of an (i+1)th frame to generate a first brightness signal to be supplied to the comparison unit.

6. The organic light emitting display as claimed in claim 2, wherein the threshold value is between about 1% to about 20% change.

7. The organic light emitting display as claimed in claim 6, wherein the threshold value is between about 5% to about 10% change.

8. The organic light emitting display as claimed in claim 2, wherein the comparison unit generates a first control signal if the difference between the brightness value of the first brightness signal of the ith frame and the brightness value of the first brightness signal of the (i−1)th frame is within the threshold value and generates a second control signal in other cases.

9. The organic light emitting display as claimed in claim 8, wherein the controller generates the second brightness signal increased or reduced from the brightness value of the first brightness signal of the (i−1)th frame by the threshold value when the second control signal is input.

10. The organic light emitting display as claimed in claim 9, wherein the increase or reduction process is repeated for each frame until the brightness value of the second brightness signal is the same as the brightness value of the first brightness signal of the ith frame.

11. The organic light emitting display as claimed in claim 2, wherein the brightness controller further comprises a delay unit for delaying the first brightness signal by at least one frame period to supply the delayed first brightness signal to the determining unit.

12. The organic light emitting display as claimed in claim 1, further comprising emission control lines coupled to the pixels, wherein the emission control unit is an emission control line driver for controlling supply time of emission control signals supplied to the emission control lines in order to control the emission time.

13. The organic light emitting display as claimed in claim 12, wherein the pixels that receive the emission control signals are in a non-emission state.

14. The organic light emitting display as claimed in claim 1, wherein the pixels control an amount of current that flows from a first power source to a second power source via organic light emitting diodes according to data signals supplied from the data lines.

15. The organic light emitting display as claimed in claim 14, further comprising power source lines coupled to the pixels, wherein the emission control unit is a power source unit for controlling supply time of the first power source or the second power source supplied to the power source lines in order to control the emission time.

16. The organic light emitting display as claimed in claim 1, further comprising:

a scan driver for supplying scan signals to the scan lines; and a data driver for supplying data signals to the data lines.

17. A method of driving an organic light emitting display, comprising:

inputting a first brightness signal of an ith frame;

outputting the first brightness signal of the ith frame if the first brightness signal of the ith frame is a normal signal;

averaging brightness values of first brightness signals of at least two frames adjacent to the ith frame if the first brightness signal of the ith frame is an abnormal signal;

determining whether the difference between brightness values of the ith frame and the (i−1)th frame is less than a threshold value; and increasing or reducing the brightness value of the first brightness signal of the (i−1)th frame by the threshold value during each frame if the difference is not less than the threshold.

18. The method as claimed in claim 17, further comprising determining that the first brightness signal is normal if the duration of the first brightness signal is the same as a frame duration and determining that the first brightness signal is the abnormal signal in other cases.

19. The method as claimed in claim 17, wherein the threshold value is between 1% to about 20% change.

20. The method as claimed in claim 19, wherein the threshold value is between about 5% to about 10% change.

* * * * *